US009345302B2

(12) United States Patent
Chung

(10) Patent No.: US 9,345,302 B2
(45) Date of Patent: May 24, 2016

(54) ELECTRO-HEATING HAIR CURLING APPARATUS

(71) Applicant: EVER BRIDGE INTERNATIONAL CO., LTD., New Taipei (TW)

(72) Inventor: Chien-Lan Chung, New Taipei (TW)

(73) Assignee: Ever Bridge International Co., Ltd., New Taipei (TW)

( * ) Notice: Subject to any disclaimer, the term of this patent is extended or adjusted under 35 U.S.C. 154(b) by 0 days.

(21) Appl. No.: 14/589,042

(22) Filed: Jan. 5, 2015

(65) Prior Publication Data

US 2015/0189965 A1 Jul. 9, 2015

(30) Foreign Application Priority Data

Jan. 6, 2014 (TW) ..... 103200196

(51) Int. Cl.
*A45D 2/36* (2006.01)
*A45D 6/02* (2006.01)

(52) U.S. Cl.
CPC . *A45D 2/367* (2013.01); *A45D 6/02* (2013.01)

(58) Field of Classification Search
CPC ..... A45D 2/367; A45D 2/00; A45D 2/36; A45D 2/02; A45D 4/06; A45D 4/12; A45D 1/00; A45D 1/04; A45D 1/16; A45D 1/28; A45D 2001/004; A45D 2001/045; A45D 6/00; A45D 6/02; A45D 6/04; A45D 6/08; A45D 6/10; A45D 6/20
USPC ..... 132/235, 210, 211, 212, 223, 224, 226, 132/227, 229, 230, 237, 238, 269, 271, 245, 132/254, 265
See application file for complete search history.

(56) References Cited

U.S. PATENT DOCUMENTS

| | | | | | |
|---|---|---|---|---|---|
| 1,887,482 | A * | 11/1932 | Pfortner | A45D 4/00 | 132/229 |
| 4,177,824 | A * | 12/1979 | Gnaga | A45D 6/06 | 132/238 |
| 4,829,156 | A * | 5/1989 | Thompson | A45D 1/04 | 132/232 |
| 5,711,323 | A * | 1/1998 | Denebeim | A45D 1/04 | 132/227 |
| 8,132,571 | B1 * | 3/2012 | Jackson | A45D 1/04 | 132/211 |
| 8,607,804 | B2 * | 12/2013 | De Benedictis | A45D 2/02 | 132/237 |
| 8,646,465 | B2 * | 2/2014 | Tam | A45D 2/12 | 132/211 |
| 8,651,118 | B2 * | 2/2014 | De Benedictis | A45D 2/02 | 132/238 |
| 2012/0325262 | A1 * | 12/2012 | Sansole | A45D 2/02 | 132/210 |
| 2013/0233336 | A1 * | 9/2013 | Lazzaro | A45D 2/08 | 132/229 |
| 2015/0047667 | A1 * | 2/2015 | Mandica | A45D 1/04 | 132/211 |

(Continued)

*Primary Examiner* — Rachel Steitz
(74) *Attorney, Agent, or Firm* — Rosenberg, Klein & Lee

(57) ABSTRACT

An electro-heating hair curling apparatus includes a casing, a tube-shaped member, a rotatable assembly, a motor, a peripheral member, a first electro-heating device, a second electro-heating device and a control unit. The casing includes a handle part and a hair-accommodating part. The tube-shaped member and the peripheral member are disposed in the hair-accommodating part. When a length of hair passes through a breach of the hair-accommodating part to dispose in a space between the tube-shaped member and the peripheral member, the control unit selectively controls the motor to drive the rotatable assembly to engage the hair on the tube-shaped member and further to rotate and wind the hair around and onto the tube-shaped member. The control unit also controls the first electro-heating device and the second electro-heating device to heat and thus style the hair wound around the tube-shaped member.

10 Claims, 4 Drawing Sheets

(56) References Cited

U.S. PATENT DOCUMENTS

2015/0114425 A1* 4/2015 Park ..... A45D 2/367
132/229
2015/0196105 A1* 7/2015 Leung ..... A45D 1/04
132/228
2015/0201727 A1* 7/2015 De Benedictis ..... A45D 2/02
132/211
2015/0216281 A1* 8/2015 De Benedictis ..... A45D 2/02
132/230

* cited by examiner

ELECTRO-HEATING HAIR CURLING APPARATUS

This application claims the benefit of Taiwan Patent Application Serial 103200196, filed Jan. 6, 2014, the subject matter of which is incorporated herein by reference.

BACKGROUND OF INVENTION

1. Field of the Invention

The invention relates to an electro-heating hair curling apparatus, and more particularly to the hand-held and DC-energized electro-heating hair curling apparatus that can be easily operated without hurting hair quality.

2. Description of the Prior Art

In the market, several hand-held apparatuses are found to utilize electro-heating energy for styling the hair. However, these hand-held hair-styling apparatuses use versatile electro-heating elements to contact the hair directly, from which hurting or damages upon the hair would be obviously inevitable. Conventionally, most of the hand-held hair-styling apparatuses adopt a clamp with an upper and a lower clip arms to hold the hair in between. Such a design limits the size of the hand-held part and further contributes adversely to the weight arrangement for the hand-held hair-styling apparatus.

In addition, these conventional hand-held hair-styling apparatuses are still far from satisfaction in user comfort and convenience.

Further, most of these conventional hand-held hair-styling apparatuses adopt AC sources, from which the accompanying electromagnetic waves would hit the user directly and thus the respective hurt to the user's body would be inevitable. Also, as long as no AC source is available, these conventional hand-held hair-styling apparatuses would be of no use. Therefore, the usage thereof is substantially limited.

SUMMARY OF THE INVENTION

Accordingly, it is the primary object of the present invention to provide an electro-heating hair curling apparatus that is hand-held, DC-energized and easily operated without hurting hair quality, such that the aforesaid shortcomings of the conventional hand-held hair-styling apparatus can be overcome.

In the present invention, the electro-heating hair curling apparatus includes a casing, a tube-shaped member, a rotatable assembly, a motor, a peripheral member, a first electro-heating device, a second electro-heating device, a power supply and a control unit. The casing includes a handle part and a hair-accommodating part, in which the handle part is defined with a longitudinal direction, and the hair-accommodating part further has a protection cover, a perimeter structure and a breach. The protection cover is formed at a top of the handle part and defined with a central direction, where the central direction is substantially perpendicular to the longitudinal direction. The perimeter structure is extended from the protection cover to surround the central direction. The breach is formed on the perimeter structure. The tube-shaped member is mounted at the protection cover and extends along the central direction. The rotatable assembly is located inside the hair-accommodating part by closing to a top of the tube-shaped member. The motor is located inside the hair-accommodating part and operationally coupled with the rotatable assembly. The peripheral member having a configuration matching the perimeter structure is mounted at the protection cover and located inner to the perimeter structure. The first electro-heating device is installed inside the tube-shaped member and thermally coupled with the tube-shaped member. The second electro-heating device is installed inside the peripheral member and thermally coupled with the peripheral member. The power supply is located in the handle part. The control unit is located in the handle part and is electrically coupled respectively with the motor, the first electro-heating device and the second electro-heating device. As a length of hair passes the breach to dispose in the space between the tube-shaped member and the peripheral member, the control unit selectively controls the motor to drive the rotatable assembly to engage the length of hair on the tube-shaped member and so as further to rotate and wind the length of hair around the tube-shaped member, the control unit also controls the first electro-heating device and the second electro-heating device to heat and thus style the length of hair wound around the tube-shaped member. The power supply is to provide electric energy for operating the motor, the first electro-heating device, the second electro-heating device and the control unit.

Further, the electro-heating hair curling apparatus further includes a touch unit mounted around the breach and electrically coupled with the control unit. As the length of hair passes through the breach to dispose inside the space between the tube-shaped member and the peripheral member, the touch unit is triggered to generate a trigger signal to be forwarded to the control unit, and the control unit then bases on the trigger signal to control the motor to drive the rotatable assembly to reel the length of hair around the tube-shaped member. Also, the control unit further controls the first electro-heating device and the second electro-heating device to heat and thus style the length of hair wound around the tube-shaped member.

In one embodiment of the present invention, the power supply includes a chargeable battery.

In one embodiment of the present invention, the first electro-heating device can be selected from a group of a ceramic electro-heating component, a polyimide electro-heating film component, a silicon electro-heating film component, an electro-heating fabric component or any thermal element or electro-heating component that can be installed into the tube-shaped member.

In one embodiment of the present invention, the second electro-heating device can be selected from a group of a ceramic electro-heating component, a polyimide electro-heating film component, a silicon electro-heating film component, an electro-heating fabric component or any thermal element or electro-heating component that can be installed into the peripheral member.

By compared to the prior art, the electro-heating hair curling apparatus of the present invention can be easily operated, no harm to the hair quality, DC-energized and hand-held, such that the electro-heating hair curling apparatus can be applied anywhere and anytime by any kind of the users.

All these objects are achieved by the electro-heating hair curling apparatus described below.

BRIEF DESCRIPTION OF THE DRAWINGS

The present invention will now be specified with reference to its preferred embodiment illustrated in the drawings, in which.

DESCRIPTION OF THE PREFERRED EMBODIMENT

The invention disclosed herein is directed to an electro-heating hair curling apparatus. In the following description, numerous details are set forth in order to provide a thorough understanding of the present invention. It will be appreciated by one skilled in the art that variations of these specific details are possible while still achieving the results of the present invention. In other instance, well-known components are not described in detail in order not to unnecessarily obscure the present invention.

Figure 1:
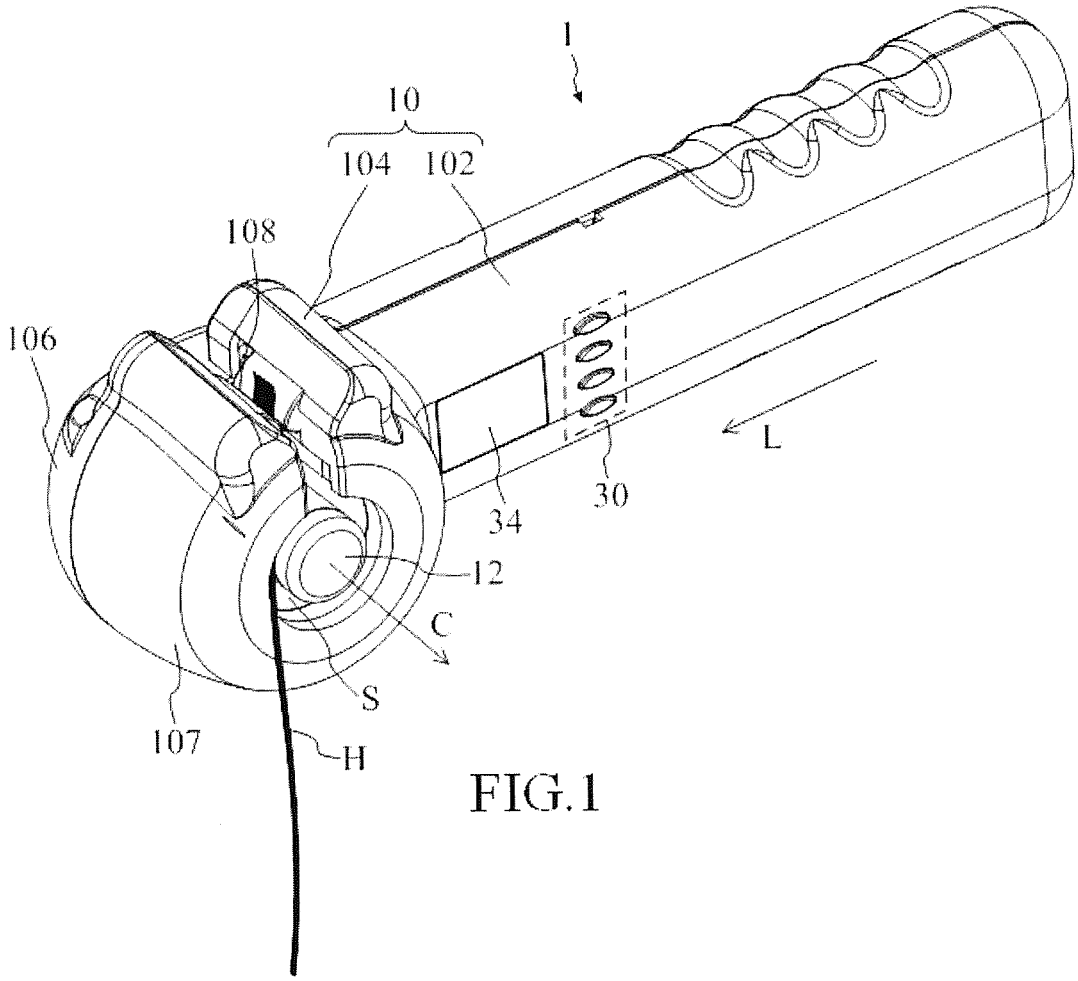
FIG. 1 is a perspective view of the preferred electro-heating hair curling apparatus in accordance with the present invention.
Figure 2:
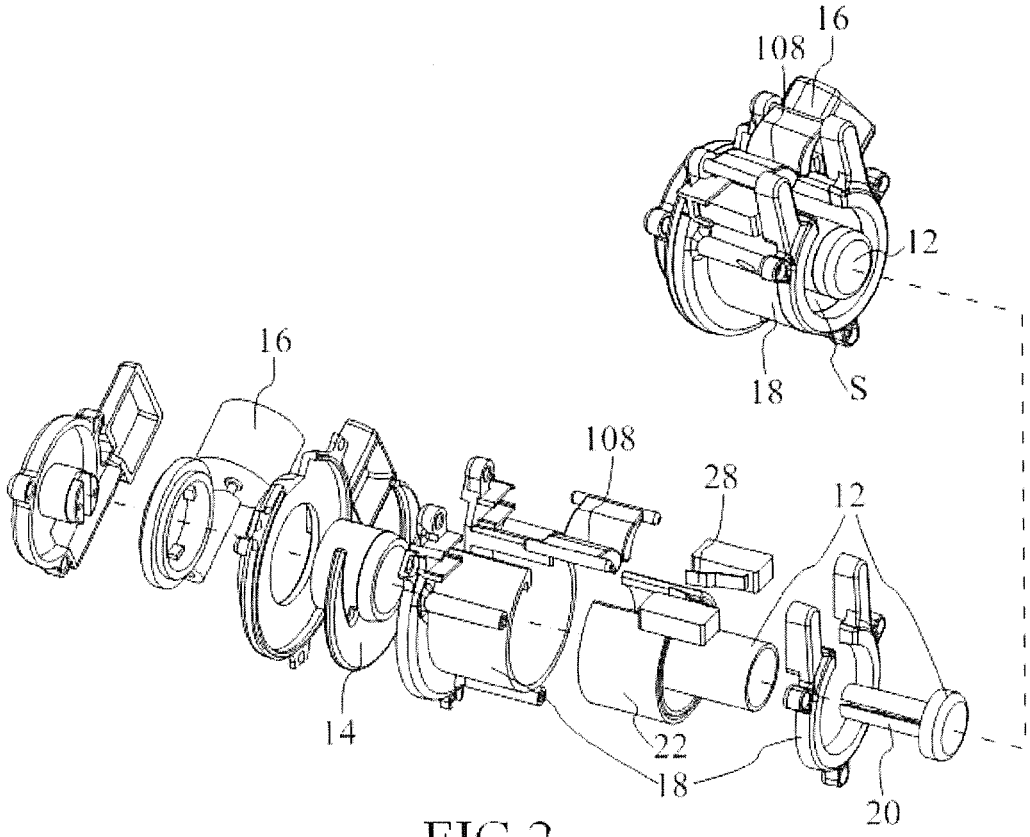
FIG. 2 is an exploded view of the hair-accommodating part of FIG. 1.
Figure 3:
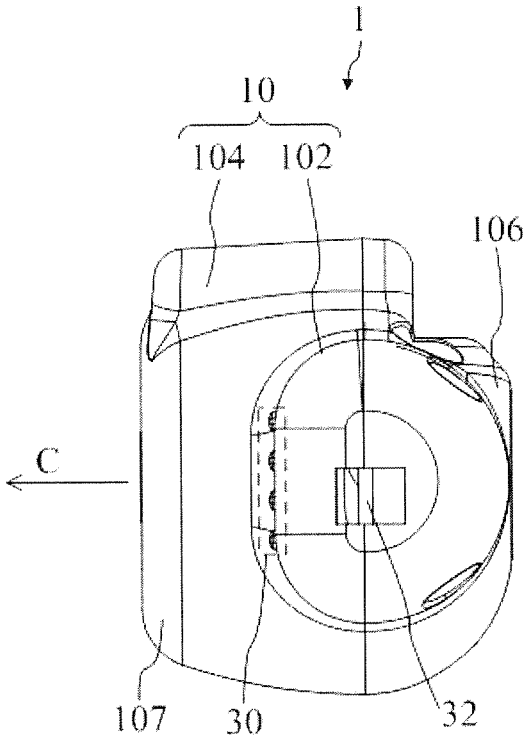
FIG. 3 is a side view of FIG. 1, showing the tail portion of the hair-accommodating part of the electro-heating hair curling apparatus.
Figure 4:
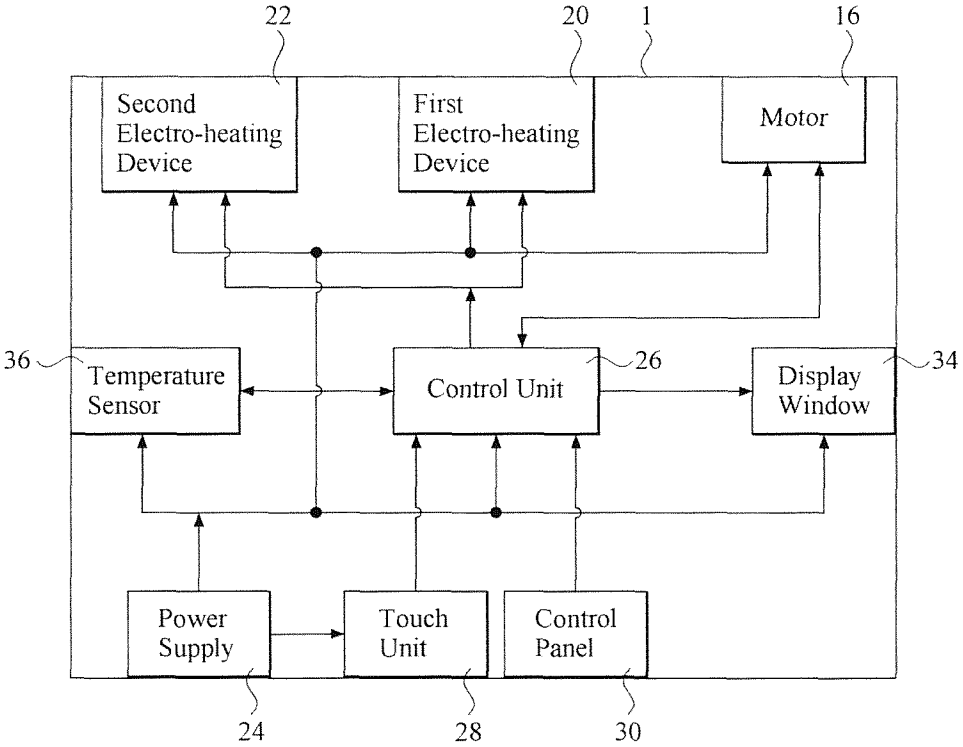
FIG. 4 is a block diagram of the preferred electro-heating hair curling apparatus of FIG. 1.

Refer now to FIG. 1 through FIG. 4, in which FIG. 1 is a perspective view of the preferred electro-heating hair curling apparatus 1 in accordance with the present invention, FIG. 2 is an exploded view of the hair-accommodating part 104 of FIG. 1, FIG. 3 is a side view of FIG. 1 showing the tail portion of the hair-accommodating part 104, and FIG. 4 is a block diagram of the preferred electro-heating hair curling apparatus 1 of FIG. 1.

As shown in FIG. 1, FIG. 2, FIG. 3 and FIG. 4, the preferred electro-heating hair curling apparatus 1 of the present invention includes a casing 10, a tube-shaped member 12, a rotatable assembly 14, a motor 16, a peripheral member 18, a first electro-heating device 20, a second electro-heating device 22, a power supply 24 and a control unit 26.

The casing 10 includes a handle part 102 and a hair-accommodating part 104. The handle part 102 is defined with a longitudinal direction L. In contrast to the conventional hand-held hair-styling apparatus described in the background section, the electro-heating hair curling apparatus 1 of the present invention adopts a single-stem design. Namely, the electro-heating hair curling apparatus 1 of the present invention includes a single handle part 102.

The hair-accommodating part 104 has a protection cover 106, a perimeter structure 107 and a breach 108. The protection cover 106 is located at a top of the handle part 102 and is defined with a central direction C, in which the central direction C is substantially perpendicular to the longitudinal direction L. The perimeter structure 107 is located in a manner of extending from the protection cover 106 and encircling around the central direction C. The breach 108 is formed on the perimeter structure 107.

The tube-shaped member 12 is constructed on the protection cover 106 and extends along the central direction C inside the hair-accommodating part 104. The rotatable assembly 14 is mounted inside the hair-accommodating part 104 by closing to the top end of the tube-shaped member 12. The motor 16 is also located inside the hair-accommodating part 104 to operationally couple the rotatable assembly 14. The peripheral member 18 having a configuration to pair the perimeter structure 107 is constructed on the protection cover 106 and disposed inside the perimeter structure 107.

The first electro-heating device 20 is installed inside the tube-shaped member 12 and is thermally coupled with the tube-shaped member 12. The second electro-heating device 22 is installed inside the peripheral member 18 and is thermally coupled with the peripheral member 18. The power supply 24 is disposed inside the handle part 102. The control unit 26 is also mounted inside the handle part 102 and is electrically coupled with the motor 16, the first electro-heating device 20 and the second electro-heating device 22.

The user can hold the handle part 102 with a single hand and can pose the protection cover 106 to face the user. Another hand of the user can pull a proper length of hair H to the space S between the tube-shaped member 12 and the peripheral member 18 by passing the breach 108. Certainly, the user can also operate the electro-heating hair curling apparatus to perform curl-styling upon other people's hair.

As the length of hair H is placed into the space S between the tube-shaped member 12 and the peripheral member 18, the control unit 26 is then, after receiving a command or a trigger signal, to manipulate the motor 16 to rotate in a predetermined direction so as to further drive the rotatable assembly 14 to engage the hair H on the tube-shaped member 12, in which the hair H is placed in the place S by passing the breach 108 in a cross manner. Through the rotation of the rotatable assembly 14, the length of hair H is gradually reeled and completely pulled into the space S from the engaged portion of the hair H to the free end of the hair H. The hair H inside the space S is wound around the tube-shaped member 12. In the present invention, the motor 16 can be automatically stopped by setting while in meeting a predetermined round or a threshold resistance.

Then, the control unit 26 can control the heating of the first electro-heating device 20 and the second electro-heating device 22, where the heating can be set with predetermined time duration and a predetermined heating temperature for styling the hair H wound around the tube-shaped member 12. In the present invention, the motor 16 and the rotatable assembly 14 mayn't induce further tension to the hair H. Actually, the hair H is wound around the tube-shaped member 12 in the space S between the tube-shaped member 12 and the peripheral member 18. Hence, the hair H wound inside the space S can be styled thermally without other foreign forcing to damage the hair. After the styling of the hair H is finished, the control unit 26 would control the rotatable assembly 14 to release the hair H, such that the hair H can be relieved from the space S between the tube-shaped member 12 and the peripheral member 18.

The power supply 24 provides electric energy to the motor 16, the first electro-heating device 20, the second electro-heating device 22 and the control unit 26.

In one embodiment of the present invention, the power supply 24 can include chargeable batteries. Thereby, the operation of the electro-heating hair curling apparatus 1 can be away from an AC source. Also, by arranging the chargeable batteries to have a workable voltage within the safe DC voltage range for the electro-heating hair curling apparatus 1, no electromagnetic harm and no risk of electric shock can be possible to the user.

In one embodiment of the present invention, the power supply 24 can further include a connection jacket 32 for establishing connection with a foreign AC power source. As shown in FIG. 3, the motor 16, the first electro-heating device 20, the second electro-heating device 22 and other elements of the electro-heating hair curling apparatus 1 can be operated by an AC voltage.

Further, the electro-heating hair curling apparatus 1 can include a touch unit 28 mounted around the breach 108 and electrically coupled with the control unit 26. As the length of hair H passes the breach 108 to dispose inside the space S between the tube-shaped member 12 and the peripheral member 18, the touch unit 28 would be triggered to generate a trigger signal to be forwarded to the control unit 26, the control unit 26 would then control the motor 16 to drive the rotatable assembly 14 to reel the length of hair H around tube-shaped member 12 according to the trigger signal, and further the control unit 26 would control the first electro-heating device 20 and the second electro-heating device 22 to heat and thus style the hair H wound around the tube-shaped member 12. Preferably, while the control unit 26 receives the trigger signal, a delay time (about a few seconds) can be set for the control unit 26 to start the motor 16.

In one embodiment of the present invention, the touch unit 28 can be a micro switch, a photo detector or any type of touch unit that is relevant to be mounted around the breach 108.

Further, the electro-heating hair curling apparatus 1 of the present invention can include a temperature sensor 36 mounted inside the space S and electrically coupled with the control unit 26. While the electro-heating hair curling apparatus 1 of the present invention is operated, the temperature sensor 36 can detect the temperature inside the space S and send a temperature signal to the control unit 26, and then the control unit 26 can base on the received temperature signal to control the heating of the first electro-heating device 20 and the second electro-heating device 22.

In one embodiment of the present invention, the first electro-heating device 20 can mainly include a ceramic electro-heating component, a polyimide electro-heating film component, a silicon electro-heating film component, an electro-heating fabric component or any thermal element or electro-heating component that can be installed into the tube-shaped member 12. In the art, the ceramic electro-heating component is a device that is made up by burying metal wires into a ceramic substrate or matrix, the polyimide electro-heating film component is a device that is made up by burying metal wires into a polyimide film, the silicon electro-heating film component is a device that is made up by burying metal wires into a silicon film, and the electro-heating fabric component is a device that is made up by weaving fine metal wires or metalized yarns.

In one embodiment of the present invention, the second electro-heating device 22 can mainly include a ceramic electro-heating component, a polyimide electro-heating film component, a silicon electro-heating film component, an electro-heating fabric component or any thermal element or electro-heating component that can be installed into the peripheral member 18.

Further, the electro-heating hair curling apparatus 1 of the present invention can include a control panel 30 constructed at the handle part 102 and electrically coupled with the control unit 26. The user of the apparatus can input commands to the control unit 26 via the control panel 30. Based on the commands and the aforesaid trigger signal, the control unit 26 controls the motor 16 to drive the rotatable assembly 14 to engage the hair H onto the tube-shaped member 12 and further rotate the tube-shaped member 12 to wind the hair therearound. The control unit 26 then controls the heating process of the first electro-heating device 20 and the second electro-heating device 22 so as to heat and style the hair wound on the tube-shaped member 12.

Further, the electro-heating hair curling apparatus 1 of the present invention can include a display window 34 to be mounted at the handle part 102 and electrically coupled with the control unit 26. The control unit 26 outputs display signals to the display window 34, and the display window 34 can also display the display signals sent from the control unit 26.

While the present invention has been particularly shown and described with reference to a preferred embodiment, it will be understood by those skilled in the art that various changes in form and detail may be without departing from the spirit and scope of the present invention.

What is claimed is:

1. An electro-heating hair curling apparatus, comprising:

a casing, including a handle part and a hair-accommodating part, the handle part defined with a longitudinal direction, the hair-accommodating part having a protection cover, a perimeter structure and a breach, the protection cover formed at a top of the handle part and defined with a central direction, the central direction being perpendicular to the longitudinal direction, the perimeter structure being extended from the protection cover to surround the central direction, the breach being formed on the perimeter structure;

a tube-shaped member, mounted at the protection cover and extending along the central direction;

a rotatable assembly, located inside the hair-accommodating part adjacent to a top end of the tube-shaped member;

a motor, located inside the hair-accommodating part and operationally coupled with the rotatable assembly;

a peripheral member, having a configuration matching the perimeter structure, mounted at the protection cover and located inner to the perimeter structure;

a first electro-heating device, installed inside the tube-shaped member and thermally coupled with the tube-shaped member;

a second electro-heating device, installed inside the peripheral member and thermally coupled with the peripheral member;

a power supply, located in the handle part; and a control unit, located also in the handle part, electrically coupled with the motor, the first electro-heating device and the second electro-heating device;

wherein, after a length of hair is placed into a space between the tube-shaped member and the peripheral member through the breach, the control unit selectively controls the motor to drive the rotatable assembly to engage the length of hair on the tube-shaped member so as to rotate and wind the length of hair onto the tube-shaped member, and the control unit also controls the first electro-heating device and the second electro-heating device to heat so as to style the length of hair wound around the tube-shaped member;

wherein the power supply provides electric energy to the motor, the first electro-heating device, the second electro-heating device and the control unit.

2. The electro-heating hair curling apparatus of claim 1, further including a touch unit mounted around the breach and electrically coupled with the control unit, wherein, as the length of hair passes through the breach to dispose inside the space between the tube-shaped member and the peripheral member, the touch unit is triggered to generate a trigger signal to be forwarded to the control unit, based on the trigger signal, the control unit controls the motor to drive the rotatable assembly to reel the length of hair around the tube-shaped member, and the control unit further controls the first electro-heating device and the second electro-heating device to heat and thus style the length of hair wound around the tube-shaped member.

3. The electro-heating hair curling apparatus of claim 2, wherein the touch unit is a micro switch.

4. The electro-heating hair curling apparatus of claim 2, wherein the touch unit is a photo detector.

5. The electro-heating hair curling apparatus of claim 2, further including a control panel constructed at the handle part and electrically coupled with the control unit, wherein a user utilizes the control panel to input a command for the control unit, based on the trigger signal, the control unit controls the motor to drive the rotatable assembly to engage the length of hair onto the tube-shaped member and further rotate the tube-shaped member to wind the length of hair, and the control unit controls the first electro-heating device and the second electro-heating device to heat and thus style the length of hair wound around the tube-shaped member.

6. The electro-heating hair curling apparatus of claim 1, wherein the first electro-heating device is selected from a group of a ceramic electro-heating component, a polyimide electro-heating film component, a silicon electro-heating film component and an electro-heating fabric component.

7. The electro-heating hair curling apparatus of claim 1, wherein the second electro-heating device is selected from a group of a ceramic electro-heating component, a polyimide electro-heating film component, a silicon electro-heating film component and an electro-heating fabric component.

8. The electro-heating hair curling apparatus of claim 1, wherein the power supply includes a chargeable battery.

9. The electro-heating hair curling apparatus of claim 8, wherein the power supply further includes a connection jacket for establishing connection with a foreign AC power source.

10. The electro-heating hair curling apparatus of claim 1, further including a display window to be mounted at the handle part and electrically coupled with the control unit, wherein the control unit outputs display signals to the display window, and the display window also displays the display signals sent from the control unit.

* * * * *